United States Patent [19]

Overheidt

[11] Patent Number: 5,005,490

[45] Date of Patent: Apr. 9, 1991

[54] RAILWAY HOPPER CAR SLIDING GATE SEALING MECHANISM

[75] Inventor: Robert P. Overheidt, Geneva, Ill.

[73] Assignee: Miner Enterprises, Inc., Geneva, Ill.

[21] Appl. No.: 558,906

[22] Filed: Jul. 26, 1989

[51] Int. Cl.[5] ..... B61D 7/22

[52] U.S. Cl. ..... 105/282.2; 49/485; 49/493

[58] Field of Search ..... 105/282.2, 282.1, 282.3; 49/475, 485, 493

[56] References Cited

U.S. PATENT DOCUMENTS

| | | | |
|---|---|---|---|
| 2,360,276 | 10/1944 | Redmond | 49/485 |
| 2,608,728 | 9/1952 | Montgomery | 49/485 |
| 3,224,382 | 12/1965 | Floehr | 105/282.2 |
| 3,255,714 | 6/1966 | Dorey | 105/282.2 |
| 3,385,232 | 5/1968 | Dorey | 105/282.2 |
| 3,827,374 | 8/1974 | Winsor | 105/282.2 |
| 4,253,400 | 3/1981 | Fischer et al. | 105/282.2 |
| 4,344,365 | 8/1982 | Fritz et al. | 105/282.2 |
| 4,429,921 | 2/1984 | Fritz et al. | 308/3.5 |

FOREIGN PATENT DOCUMENTS

| | | | |
|---|---|---|---|
| 0534986 | 12/1956 | Canada | 105/282.2 |
| 0587985 | 12/1959 | Canada | 105/282.2 |
| 0759254 | 5/1967 | Canada | 105/282.2 |
| 0905757 | 7/1972 | Canada | 105/282.2 |
| 0972624 | 8/1975 | Canada | 105/282.2 |

*Primary Examiner*—Matthew C. Graham
*Assistant Examiner*—Mark T. Le

[57] ABSTRACT a seal mechanism for installation in the discharge opening of a railway hopper car. The design of the seal mechanism, the type of material used and the degree of securement of the discharge opening combine to provide a semi-flexible structure. Irregularities in the structure of the discharge opening and/or the slide gate can be overcome by the flexible portions of the seal mechanism. The actual sealing is done by a pliable seal material carried in a channel. The pliable seal comprises several separate sections and the channel includes cutouts for their individual removal and insertion.

3 Claims, 2 Drawing Sheets

22
24
34e
16
34f
32c
33c
52
33d
34b
34g
14
46
32b
11
18
54
32d
50
34c
34h
33b
64
48
62
33a
56
32a
10
34b
12
34a 10
11
20
21
26
28
30
32
35
38
40
42
44
46
55
58
60
65

RAILWAY HOPPER CAR SLIDING GATE SEALING MECHANISM

BACKGROUND AND SUMMARY OF THE INVENTION

The present invention pertains to an apparatus for sealing a horizontally sliding gate which slides across the discharge opening of a railway hopper car, against the frame of said railway hopper car. When a hopper car is loaded with a fluidizing lading, such as fine particles of bauxite, bentonite, cement, flour, etc., problems are encountered with respect to that fluidizing lading sifting between the gate and the frame through the seal means. One solution to the sealing problem has to been to use gaskets, rubber or the like. However, if the gasket is to provide an effective seal, it must be securely pressed against the top surface of the gate around the entire peripheral thereof. Along with other problems, such as discussed in U.S. Pat. No. 4,253,400 to Fischer issued Mar. 3, 1981, there exists the problem that the discharge opening itself not be truly square. Additionally, since it is an integral part of the car, it may be warped and thus not square or flexed during a normal work cycle. These problems are typical in older railroad cars which are rebuilt and into which new horizontal sliding gate systems are incorporated in conjunction with a seal mechanism. Seal mechanisms, by their very nature, are subject to wear and a substantial number of clever mechanisms have been provided to lessen or minimize such wear. The wear does occur, however, and thus a method must be provided to replace the actual seal element, whatever it is. The sealing element, as well as the remainder of the seal mechanism, must be designed to allow a simple and convenient replacement of the old worn-out parts.

As compared to the prior art devices, the present invention provides a seal mechanism which compensates for a misaligned discharge opening, for flexing of the discharge opening during a work cycle, and when the inevitable occurs, for the actual and convenient removal and replacement of the pliable seal itself. In practice, the seal mechanism resembles a rectangular picture frame made up of separate flexible flange section means, which is secured in the discharge opening of the railroad hopper car. Around the entire periphery of the inside edge of the picture frame is a C-shaped channel. Carried within the C-shaped channel is a pliable seal means which in the preferred embodiment is a strip of nylon carpet wound around a steel rod. To achieve proper operation, it is important that the securement, in this embodiment, of the picture frame to the walls of the discharge opening be minimal. The welding need only be sufficient to hold the frame fixed within the discharge opening. I have found two welds on each side of the discharge opening a inch long to be sufficient. The seal mechanism is constructed in a manner and of a material which flexes to conform to the walls of the discharge opening and which when subjected to the weight of the lading is capable of bending and flexing allowing it to conform to the top of the discharge opening gate. As a result, there is substantial assurance that the seal has closed the opening when there is lading within the car. That is, the pliable sealing means (all four sides) are in a single first plane, parallel with but spaced away from a top or second plane swept out by the top surface of the slide gate. This result must be achieved irrespective of the relationship of the discharge opening walls to each other, to the rectangular picture frame and to the top surface of the slide gate. At the same time, when the car is empty and being moved from place to place, it is desirable that the pliable seal means is not in snug contact with the top surface of the horizontally sliding gate. Thus, the wear incident to the jarring and vibrations in the empty car are not present because the pliable seal floats slightly above, or at least has minimal contact with the top surface of the door.

Further objects and advantages will become apparent from the following description taken in conjunction with the drawings.

DESCRIPTION OF SPECIFIC EMBODIMENT

The following disclosure is offered for public dissemination in return for the grant of a patent. Although it is detailed to insure adequacy and aid understanding, this is not intended to prejudice that purpose of a patent which is to cover each new invention conception therein no matter how others may later disguise it by variations in form or additions or further improvements.

Figure 1:
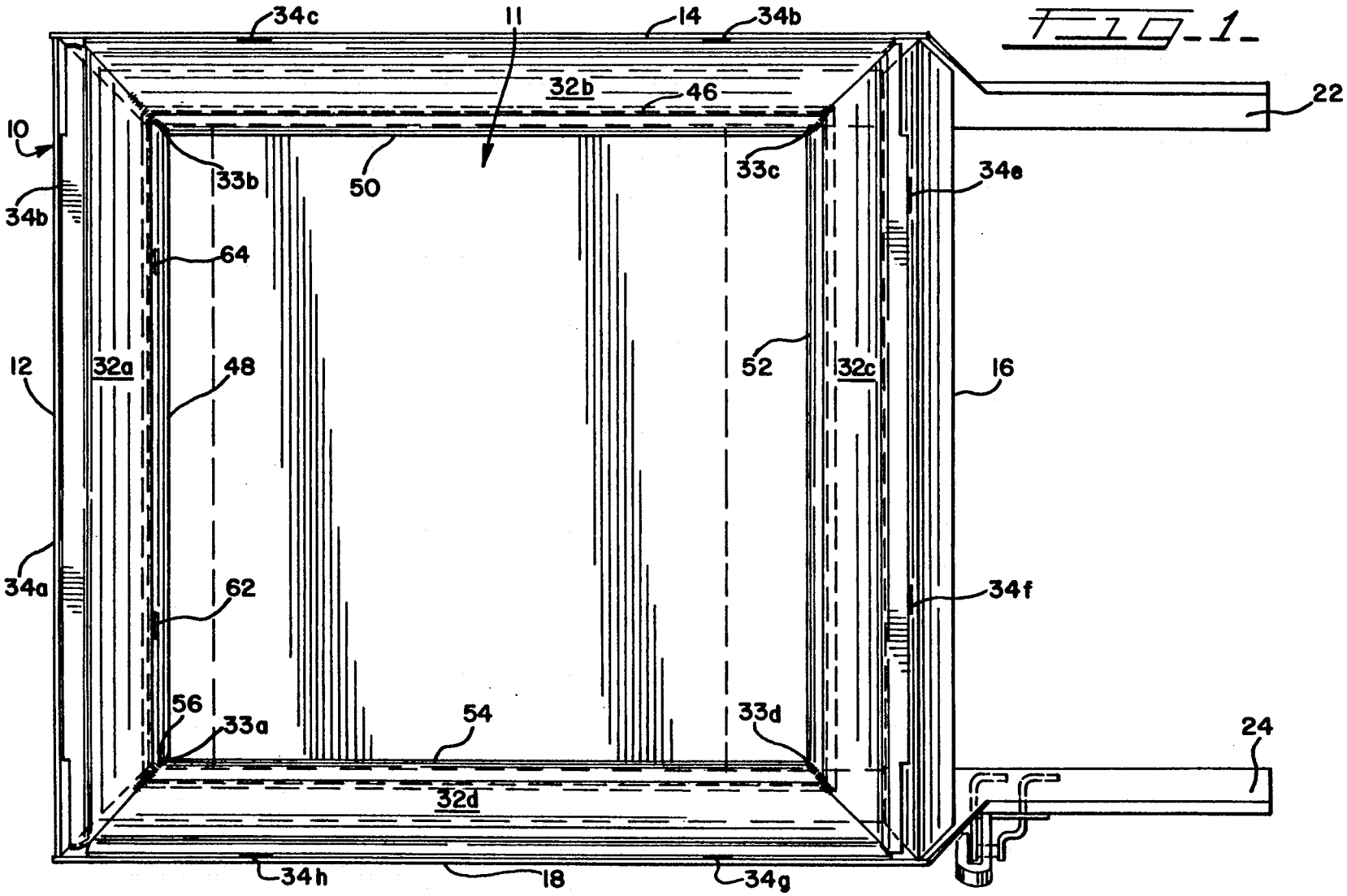
FIG. 1 is a plan view of a hopper discharge opening with the horizontal sliding gate in a closed position.
Figures 2, 3, 4:
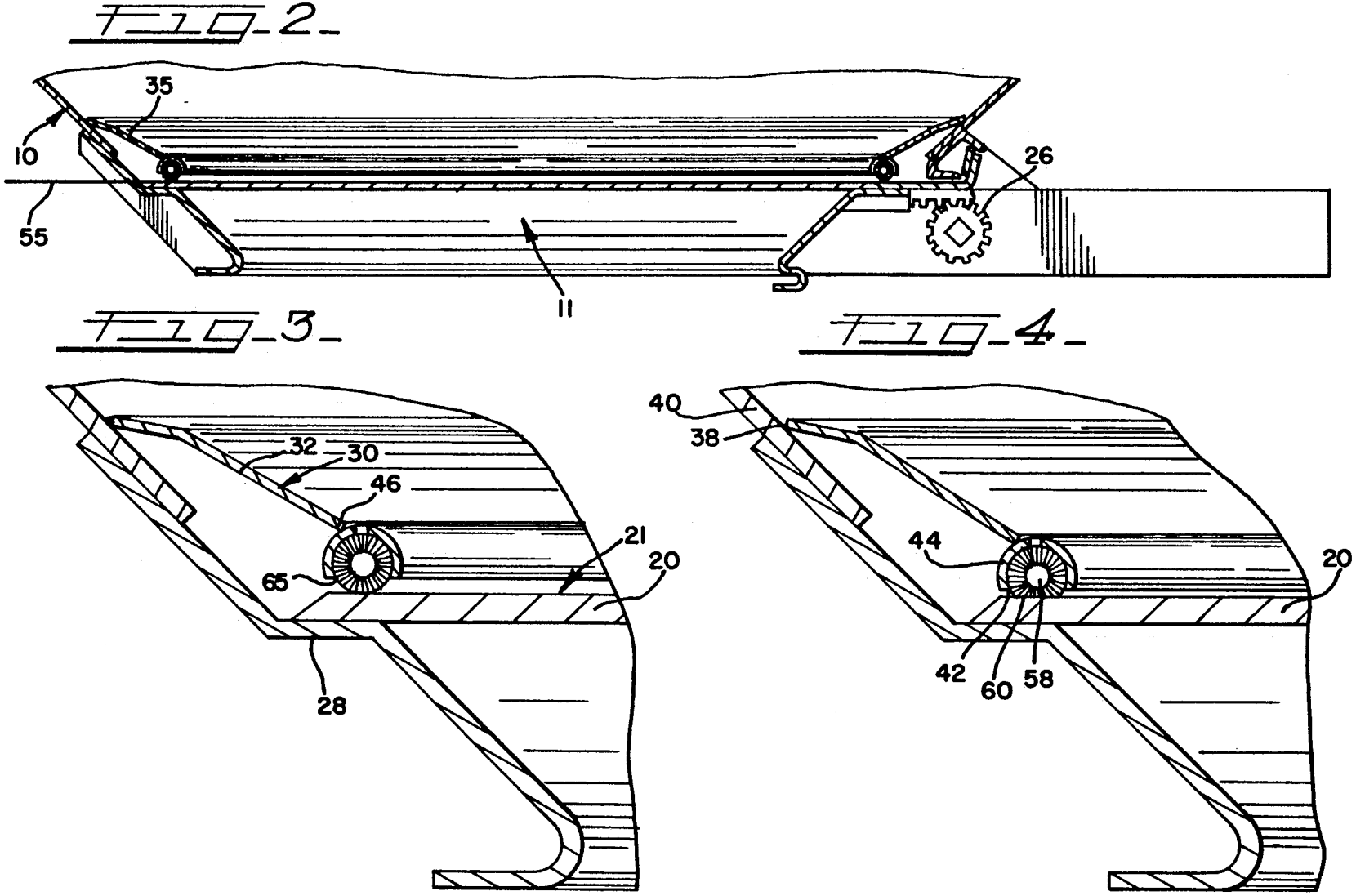
FIG. 2 is a sectional scene at line 2—2 of FIG. 1.
FIG. 3 is a similar view to that of FIG. 2 showing a portion of the picture frame sealing mechanism and sealing means but with no lading in the railroad hopper car.
FIG. 4 is the same as FIG. 3, however, showing the effect of lading in the railroad hopper car.

Referring to FIG. 1 wherein it is illustrated a part of the frame of a railroad car hopper designated as 10 which encompass the discharge opening 11 as better seen in FIG. 2. The hopper car frame 10, as partially shown in FIG. 1, consists of four sloping sides 12, 14, 16 and 18 which extend down below the level of the sliding gate 20 and actually define the opening 11. It should be appreciated that in practice the respective sloping sides are not often geometrically true. That is, especially in older used cars, the sides are bent, warped, etc., so that they do not offer anything close to a true rectangular envelope for mounting a seal. It is through the opening 11 that the lading of the car is discharged. The opening 11 as mentioned, is closed by the gate 20 which has a top surface 21 that defines a top plane. Further secured to the frame 10 are slide supports 22 and 24 upon which the gate 20 rests and slides during its reciprocating horizontal movement. A rack and pinion system 26 (only partially shown) in this preferred embodiment is used to move the gate along its horizontal path. Any suitable opening and closing mechanism can be used to activate the rack and pinion 16 for opening and closing the gates as desirable. It should be noted that when the gate 20 is in the fully opened position, it is out to the right side of the rack and pinion system shown in FIG. 2 while when in the fully closed position it is substantially as shown in FIG. 2.

As a matter of reference, side 16 defines the side of the frame 10 through which the gate moves as it traverses between an open and closed position. FIGS. 3 and 4 are of the seal arrangement on the opposite side thereof, i.e., side 12. Incorporated within side 12 is a support 28 which serves as a stop to limit the movement of the slide gate to the left. Additionally, the support 28 carries the leading edge of the slide gate when the weight of the lading presses downwardly thereupon. As thus far described, the structure, with the exception of the sealing arrangement, is substantially conventional and well known in the prior art.

The problem, as has been previously stated, is to provide a seal mechanism which is able to compensate for movement and irregularities in the discharge opening of the hopper car to close the gap between the slide gate and the walls. It has been discovered that in older cars which are being rebuilt, irregularity and misalignment from one part of the discharge opening to another can be quite substantial. The seal mechanism means 30, as previously discussed, is generally picture-frame shaped. The actual design of the four separate flange sections 32*a*, 32*b*, 32*c* and 32*d*, as well as the number and extent of the welds 34*a*, 34*b*, 34*c*, 34*d*, 34*e*, 34*f*, 34*g* and 34*h*, as shown in FIG. 1, can be basically described in functional terms. The combination of the flange and welds to the walls of the discharge opening must be such that the pliable seal of the picture frame means contacts the top of the door 20 as shown in FIG. 4. Each of the flange sections is alike and thus description will be limited to one of such sections with the understanding that it applies to the others. The flange sections 32*a*–32*d* are secured at their abutting ends 33*a*–33*d* by any suitable means. In this embodiment, I have used a short weld to secure the sections and yet not inhibit flexibility is satisfactory. The flange means 32*a* includes an outside leading edge 38, an inside or periphery edge 46 with a cantilevered section 35 extending therebetween. Secured to the inside edge 46 is a pliable seal means 42. As installed, the cantilevered section slops downwardly toward the opening 11 whereby lading material flows freely thereoff.

A better understanding can possibly be achieved by appreciating how the picture frame sealing mechanism 30 is installed about the discharge opening 11. In actual practice the sliding gate 20 is closed and then an artificial load is placed upon the picture frame seal mechanism prior to welding. This load forces the separate frame sections to assume generally the position shown in FIG. 4, each separate section 32 being forced to conform to the shape of the adjacent wall of the discharge opening while holding the plane 55 swept out by the leading edge of the liable seal means 44*a*–44*d* parallel with and adjacent to the top plane swept out by the top 21 of the slide gate 20. At that point in a compressed state, the leading edge 38 of the flange 32*a* is spot welded to the inside surface 40 of the discharge opening wall 10.

An additional feature of the invention lies in the provision of the pliable seal itself. Referring to FIGS. 1 and 2, it is apparent that the pliable seal means is carried in a C-type channel which is secured to the flange portion 32*a*–32*d* around the entire inside periphery 46 thereof. Securement to the periphery edge 46 of the flange portion can be by any suitable means such as welding, or whatever. In the preferred embodiment, the pliable seal 42 consists of a steel rod 58 around which a carpet material 60 has been wound. In a preferred embodiment, the carpet is nylon, long filament, hard twist, double back, deep pile.

In order to insure replacement of seal means 42 each C-shaped channel 48, 50, 52 and 54 has a separate independent unit. That is, the gate seal mechanism includes four separate pliable seal means 44*a*–44*d*. Each C-shaped channel independent unit, has a first opening such as 65 and second openings such as 62 and 64. The first opening is in the form of an elongated slot running the length of the channel unit. The second openings are located on the side of the channel unit opposite said first opening. Cut in the top of each of the C-shaped channel means 48, 50, 52 and 54 are slots, such as 62 and 64. When it is deemed that a sealing means 42 is sufficient worn, the slide gate 20 is placed in an open position. Thereupon a convenient tool, such as a screwdriver, is inserted into the slot 62, contacting the sealing means 42. Force is exerted downwardly against the sealing means 42 until it is dislodged from the C-shaped channel 44.

As is apparent from a consideration of the figures, the C-shaped channel generally encompasses about 270 degrees, plus or minus 10 degrees, of the circumference of the seal means 42. In comparison to the flange sections 32*a*–32*d*, the C-shaped channel, such as 44, represents a substantially rigid structure. That is, it has a strength substantially greater than that of said flanges and is not designed to flex as is the flange sections 32*a*–32*d*. In this embodiment, the C-shaped channel means has a higher section modulus than said flange sections 32*a*–32*d* and so has lower stresses and better resists deformation. This allows the firm retainment of the seal means 42 and yet with aid of a proper tool the removal thereof when worn.

From the foregoing, it will be seen that this invention is one well adapted to obtain all the ends and objects herein set forth, together with other advantages which are obvious and which are inherent to the structure.

It will be understood that certain features and subcombination are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What I claim is:

1. In a railway hopper car having a discharge opening and a slide gate, a sealing mechanism for sealing the discharge opening and the slide gate comprising:

a flange means having a generally rectangular shape and being flexible, said flange means having inside and outside leading edges and includes four separate flange section means joined by flexible connections to form said generally rectangular shape whereby each of said separate flange section means are pliable to conform with the walls of the discharge opening;

a channel means suitable for carrying a pliable sealing means, said channel means being secured to said inside edge; said pliable sealing means sweeping out a first plane;

securing means selectively fixing said outside leading edge to the discharge opening whereby said flange section means can flex under the weight of lading such that said pliable sealing means will contact said slide gate around the peripheral thereof; and said slide gate has a top surface which defines a top plane, said first plane and top plane being parallel.

2. In a railway hopper car having discharge opening walls, a slide gate and a seal for sealing said discharge opening walls against said slide gate irrespective of the relationship of the discharge opening walls to each other and to the slide gate, said sealing comprising:

flange section means joined together to form a flexible rectangular frame having inside and outside portions, said inside and outside portions being joined by a downwardly sloping cantilevered section; a pliable sealing strip means occupying a plane parallel and contiguous with a plane swept out by said slide gate;

a series of channel means having strength substantially greater than that of said flange section means and having higher section modulus than said flange section means whereby said series of channel means have lower stresses and better resists deformation, and having first and second openings, said first opening being an elongated slot running the length of said channel means, said pliable sealing means being positioned in each of said channel means whereby portions thereof are directly adjacent said gate, said second opening being generally opposite said first opening whereby providing access to remove said pliable sealing means from said channel; and means securing said outside portions of each of said flange section means to said discharge opening walls whereby said flange section means can flex so that said pliable sealing will contact said slide gate around the peripheral thereof.

3. The gate sealing means of claim 2 wherein said pliable means is a steel rod having carpet wrapped therearound, and said channel means is "C"-shaped.

* * * * *